United States Patent [19]

Watanabe et al.

[11] 4,297,838

[45] Nov. 3, 1981

[54] ELECTRONIC TIMEPIECE

[75] Inventors: Minoru Watanabe; Kazunari Kume, both of Tokorozawa; Hideshi Ohno, Sayama; Munetaka Tamaru, Tokyo, all of Japan

[73] Assignee: Citizen Watch Co. Ltd., Tokyo, Japan

[21] Appl. No.: 967,715

[22] Filed: Dec. 8, 1978

Related U.S. Application Data

[63] Continuation of Ser. No. 789,086, Apr. 20, 1977, abandoned.

[30] Foreign Application Priority Data

Apr. 27, 1976 [JP] Japan ..... 51-48285
Aug. 20, 1976 [JP] Japan ..... 51-111435

[51] Int. Cl.[2] ..... G04C 3/00
[52] U.S. Cl. ..... 368/76; 310/40 MM

[58] Field of Search ..... 58/23 D, 23 R, 23 BA; 310/40 R, 40 MM, 49 R, 49 A, 162, 163, 164

[56] References Cited

U.S. PATENT DOCUMENTS

| | | | |
|---|---|---|---|
| 2,113,693 | 4/1938 | Junghans | 310/163 |
| 2,435,911 | 2/1948 | Van Der Woude | 310/163 |
| 3,824,781 | 7/1974 | Diersbock | 58/23 R |
| 3,898,789 | 8/1975 | Arzi et al. | 58/23 D X |
| 3,902,312 | 9/1975 | Yamazaki | 58/23 D |
| 3,989,967 | 11/1976 | Kikuyama et al. | 310/162 X |

*Primary Examiner*—Ulysses Weldon
*Attorney, Agent, or Firm*—Sherman & Shalloway

[57] ABSTRACT

An electronic timepiece comprising a step-motor including a stator and rotor is disclosed. The timepiece is so constructed and arranged that a coil winding core of the stator is located between the stator and a dial of the timepiece and that said stator is disposed on said coil winding core.

3 Claims, 8 Drawing Figures

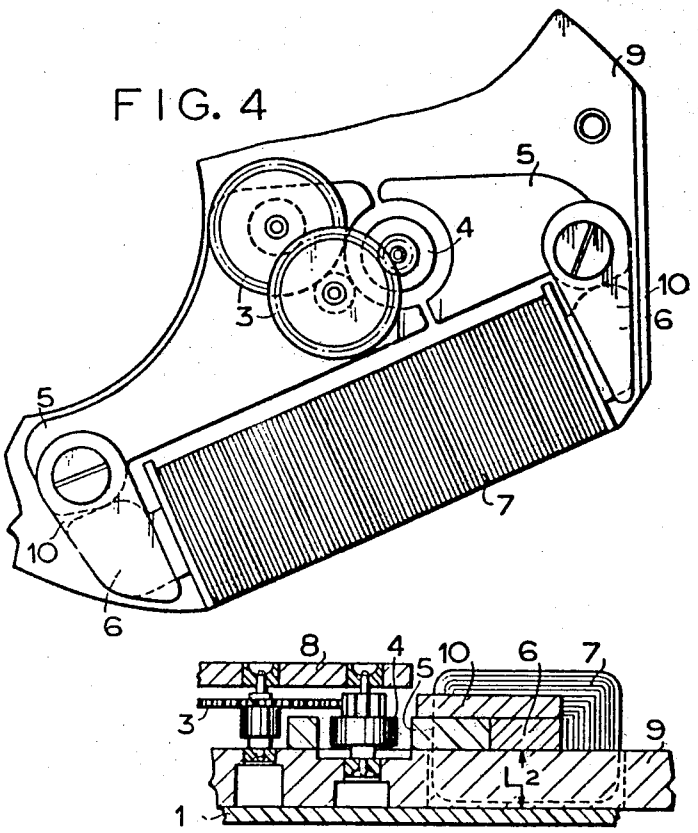
FIG. 4
FIG. 5
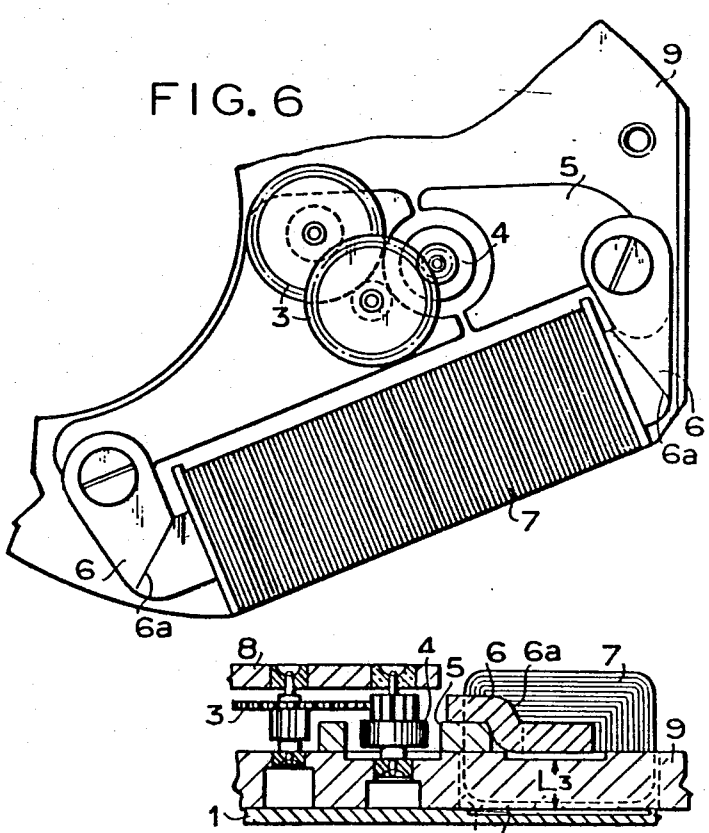
FIG. 6
FIG. 7

ELECTRONIC TIMEPIECE

This is a continuation of application Ser. No. 789,086, filed Apr. 20, 1977, now abandoned.

BACKGROUND OF THE INVENTION

This invention relates to arrangements and constructions of parts of an electronic timepiece, and more particularly to an arrangement and construction of a step-motor used as an electro-mechanical transducer and parts surrounding the stepmotor and associated therewith.

DESCRIPTION OF THE PRIOR ART

In a conventional electronic timepiece, an electric battery has a thickness which is considerably larger than those of the other parts, so that the thickness of the timepiece is determined by the thickness of surroundings of the electric battery. As a result, the other parts are constructed within a space whose thickness is substantially determined by the thickness of these surroundings. But, the thickness of the surroundings of the electric battery becomes a problem to be eliminated owing to improvement in capacity of the electric battery, economy of consumed electric power and improvement in construction for enclosing the electric battery therein.

In a conventional electronic timepiece shown in FIG. 1, reference numeral 1 designates a dial, 2 an electric battery, 3 a gear train, 4 a rotor, 5 a stator, 6 a coil winding core, 7 a coil, 8 a gear train supporting plate and 9 a substrate. As shown in FIG. 1, in the surroundings of the coil 7, on the dial 1 is disposed on the substrate 9 on which is disposed the stator 5. On the stator 5 is disposed the coil winding core 6. In practice, the height of the stator 5 is limited by the dimension of the surroundings of the gear train 3, particularly by the dimension of a center part of the timepiece. In addition, a distance L between the dial 1 and the coil winding core 6 is large and it is impossible to make the surroundings of the coil 7 thin in thickness.

In addition, in the conventional timepiece, on the substrate 9 is disposed the stator 5 and the stator 5 is provided with holes or notches, thereby making the sectional area of a magnetic circuit of the stator 5 small. The presence of such holes and notches causes direction of magnetic lines of force near the rotor 4 to disturb, thereby giving an adverse influence upon the efficiency of the step-motor and lowering the electro-mechanical transducing efficiency. Moreover, the arrangement of the parts of the time piece in the longitudinal cross section is limited by the center part of the timepiece, so that the conventional electronic timepiece has the disadvantage that the space of the timepiece could not be utilized in an efficient manner.

SUMMARY OF THE INVENTION

An object of the invention, therefore, is to provide an electronic timepiece which can obviate the above mentioned disadvantage which has been encountered with the prior technique.

Another object of the invention is to provide an electronic timepiece which can reduce a thickness of the surroundings of a coil to a thickness which is near a thickness of the coil itself.

A further object of the invention is to provide an electronic timepiece which comprises a stator closely arranged at a gear train supporting plate, which does not give an adverse influence upon the ability of an electro-mechanical transducer even when the stator and the gear train are superimposed one upon the other and which is small in size and thin in thickness.

A still further object of the invention is to provide an electronic timepiece which comprises a gear train supporting plate made integral with a stator by a spot welding and which is easy in assembly.

BRIEF DESCRIPTION OF THE DRAWINGS

FIG. 4 is a partial plan view showing another embodiment of an electronic timepiece according to the invention;

FIG. 5 is its partial longitudinal sectional view;

FIG. 6 is a partial plan view of a further embodiment of an electronic timepiece according to the invention;

FIG. 7 is its partial longitudinal sectional view; and

DESCRIPTION OF THE PREFERRED EMBODIMENT

Figure 1:
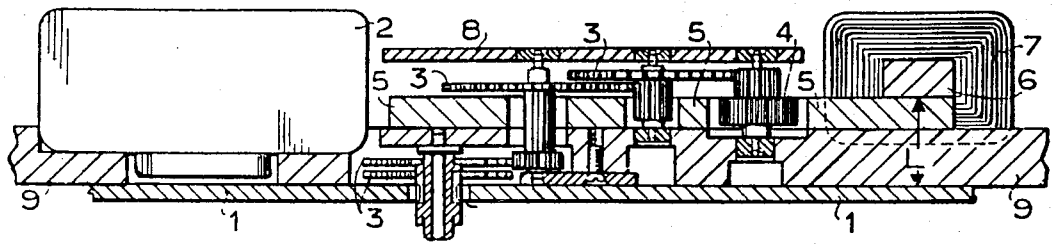
FIG. 1 (PRIOR ART)
FIG. 1 is a longitudinal cross sectional view showing a conventional electronic timepiece.
Figure 3:
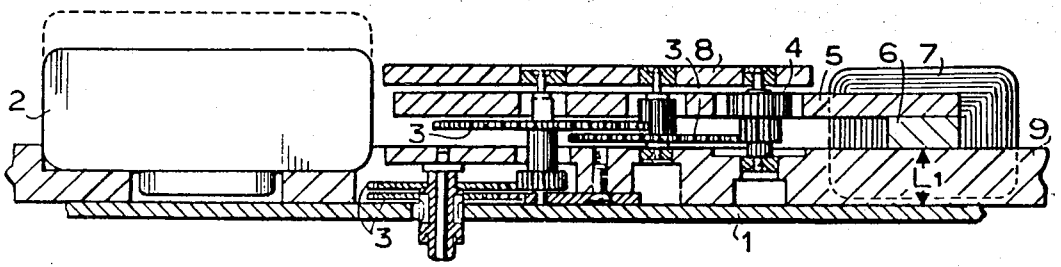
FIG. 3 is its longitudinal sectional view.
Figure 2:
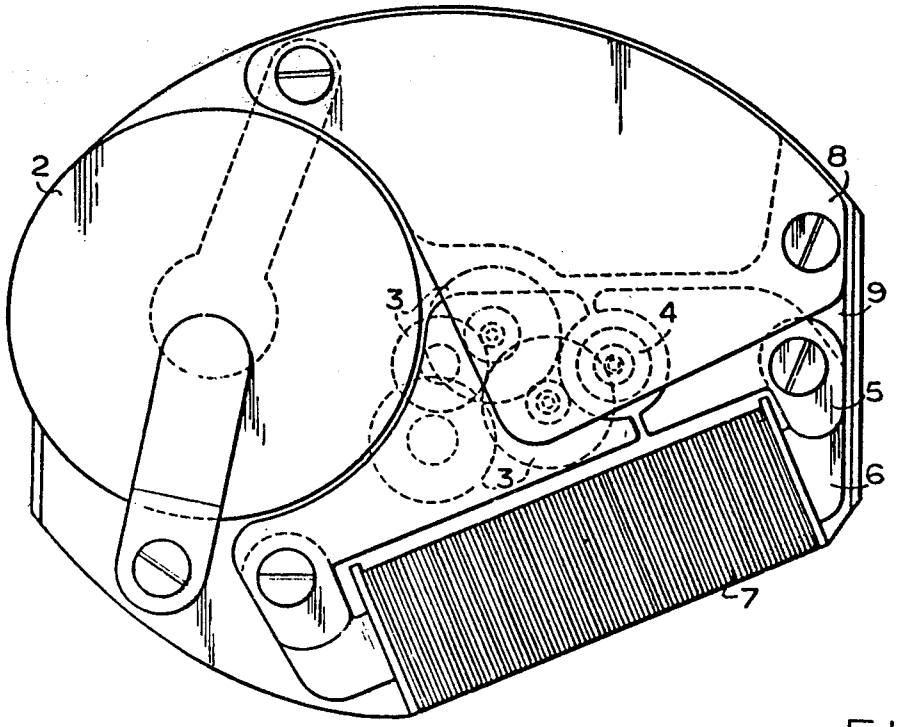
FIG. 2 is a plan view showing one embodiment of an electronic timepiece according to the invention.

In FIGS. 2 and 3 is shown one embodiment of an electronic timepiece according to the invention. In the present embodiment, use is made of an electric battery 2 and a coil winding core 6 and a stator 5 are arranged in opposition to those shown in FIG. 1. That is, in FIG. 3, on a substrate 9 is disposed the coil winding core 6 on which is disposed the stator 5. As a result, the distance L, between the coil winding core 6 and a dial 1 becomes shortened by a thickness of the stator 5. In addition, a gear train 3 is not disposed on the stator 5 at the center part of the timepiece, so that the coil 7 can be arranged at a position which is the nearest to the dial 1. The thickness of the surroundings of the coil 7 becomes equal to the thickness of the coil 7 itself.

In FIGS. 4 and 5 is shown another embodiment of the timepiece according to the invention. In the present embodiment, both the stator 5 and the coil winding core 6 are directly disposed on the substrate 9 and secured to the substrate 9 by means of a magnetic connection plate 10. In the present embodiment, the distance $L_2$ between the stator 5 and the dial 1 becomes shortened by the thickness of the stator 5. In the present embodiment, it is not necessary to make the height of the contact surface between the stator 5 and the substrate 9 equal to the height of the contact surface between the coil winding core 6 and the substrate 9.

In FIGS. 6 and 7 is shown a further embodiment of the timepiece according to the invention. As shown in FIG. 7, on a dial 1 are disposed a substrate 9, stator 5 and coil winding core 6 one upon the other in succession in the order which is the same as in the conventional timepiece shown in FIG. 1. In the present embodiment, however, the coil winding core 6 is provided at its one side with an upwardly bent portion *6a* which is disposed on the stator 5, so that it is possible to dispose the coil 7 nearer to the dial 1. For this purpose, the substrate 9 is provided at its portion opposed to the coil winding core 6 with a depression *9a* for enclosing the coil winding core 6 therein and the dial 1 is provided at its portion opposed to the coil 7 with a depression 1*a* for enclosing the coil 7 therein. As a result, it is possible to freely select the distance between the coil winding core 6 and the dial 1.

As seen from the above, the present embodiment is capable of bringing the coil winding core 6 and hence the coil 6 into a position which is the nearest to the dial 1. As a result, the thickness of the surroundings of the coil 7 becomes near the thickness of the coil 7 itself and hence become thin in thickness.

Figure 8:
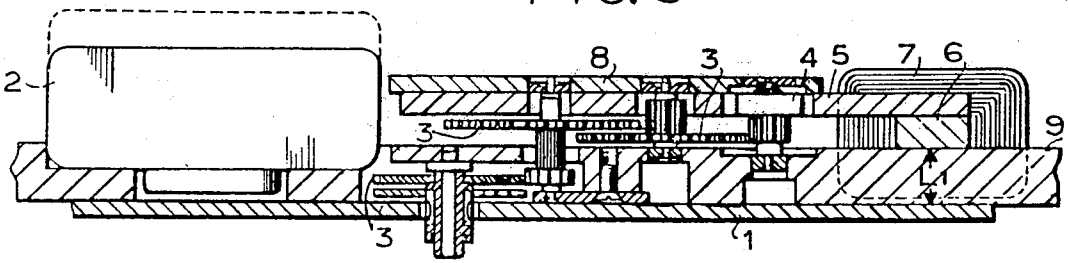
FIG. 8 is a longitudinal sectional view showing a still further embodiment of an electronic timepiece according to the invention.

In FIG. 8 is shown a still further embodiment of the timepiece according to the invention. In the present embodiment, the arrangement of the parts is the same as that of the parts of the embodiment shown in FIGS. 2 and 3. In the present embodiment, however, the stator 5 is in close contact with the gear supporting plate 8 and between the stator 5 and the substrate 9 is arranged the reduction gear train. The use of the arrangement according to the present embodiment provides the advantage that the stator 5 may be provided with relatively small holes for passing shafts for rotatably supporting a second reduction gear and that hence the electromechanical transducer is not subjected to any adverse influence contrary to the conventional timepiece. In addition, the substrate 9 may be formed at its center portion with a depression so as to reduce its thickness which is sufficient to pass through the center shaft and enclose the gear train 3 therein. As a result, the position of the gear train supporting plate 8 becomes lowered and it is possible to make the timepiece thin in thickness. In addition, the gear train supporting plate 8 may be made integral with the stator 5 by spot welding etc., thereby rendering the assembly of the parts of the timepiece easy.

As stated hereinbefore, the use of the measures described provides the important advantage that the space in the timepiece can effectively be utilized and that the electronic timepiece comprising the step-motor can be made small in size and thin in thickness in an easy manner.

In the above described embodiments, a crystal oscillator may be used as a time reference signal source, but any other time reference signal sources, for example, a tuning fork oscillator, etc. may also be used.

What is claimed is:

1. An electronic timepiece comprising a step-motor used as an electro-mechanical transducer and including a coil having a coil winding core, stator and rotor; a reduction gear train for reducing rotation of said rotor of said step-motor; a bearing for rotatably supporting at least one gear of said reduction gear train; a gear train supporting plate; and a substrate for supporting all of the above mentioned parts of the timepiece; the improvement comprising a portion of said coil winding core and said stator located in the same plane and adjacent said substrate and a second portion of said coil winding core integral with said first portion and extending on the side of said stator opposite said substrate to form a magnetic connection means between said core and a side of said stator opposite said substrate.

2. The electronic timepiece as claimed in claim 1, wherein said second portion of said coil core is an upwardly bent portion permitting the second portion of said coil core to extend on the side of said stator opposite said substrate.

3. The electronic timepiece as claimed in claim 1, wherein said reduction gear train is located on said substrate.

* * * * *